US008961275B2

(12) United States Patent
Tanaka et al.

(10) Patent No.: US 8,961,275 B2
(45) Date of Patent: Feb. 24, 2015

(54) COIN DEPOSITING AND DISPENSING MACHINE

(75) Inventors: Takashi Tanaka, Himeji (JP); Shinichi Chiba, Himeji (JP); Keita Toyama, Himeji (JP); Masao Hayashi, Himeji (JP); Atsushi Nagase, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 856 days.

(21) Appl. No.: 12/294,167

(22) PCT Filed: Mar. 30, 2007

(86) PCT No.: PCT/JP2007/057180

§ 371 (c)(1),
(2), (4) Date: Sep. 23, 2008

(87) PCT Pub. No.: WO2007/114361

PCT Pub. Date: Oct. 11, 2007

(65) Prior Publication Data

US 2009/0227193 A1 Sep. 10, 2009

(30) Foreign Application Priority Data

Apr. 4, 2006 (JP) ..... 2006-103418
Apr. 4, 2006 (JP) ..... 2006-103419
Apr. 4, 2006 (JP) ..... 2006-103420
Apr. 4, 2006 (JP) ..... 2006-103421

(51) Int. Cl.
*G07D 3/00* (2006.01)
*G07F 11/58* (2006.01)
(Continued)

(52) U.S. Cl.
CPC *G07F 11/58* (2013.01); *G07D 1/02* (2013.01); *G07D 3/14* (2013.01); *G07D 9/008* (2013.01)
USPC ..... 453/7; 453/11; 453/15; 453/56

(58) Field of Classification Search
CPC ..... G07D 1/00; G07D 1/02; G07D 3/00; G07D 3/02; G07D 3/04; G07D 3/14; G07D 3/16; G07D 5/00; G07D 5/02; G07D 5/08; G07D 9/00; G07D 9/06; G07D 9/008; G07D 9/065; G07F 1/041; G07F 5/24
USPC ..... 453/5–7, 10–13, 33–35, 49, 56, 57; 198/626.1, 699.1, 844.1; 194/334, 338
See application file for complete search history.

(56) References Cited

U.S. PATENT DOCUMENTS 4,558,711 A 12/1985 Ikuta Yoshiaki et al.
5,542,154 A * 8/1996 Demuth et al. ..... 19/114
(Continued)

FOREIGN PATENT DOCUMENTS

EP 1542174 A1 6/2005
JP 61-105696 5/1986
(Continued)

OTHER PUBLICATIONS

Office Action of JP 2006-103418 (with English Translation)—5 pages., dated Feb. 1, 2012).
(Continued)

*Primary Examiner* — Jeffrey Shapiro
(74) *Attorney, Agent, or Firm* — Renner, Kenner, Greive, Bobak, Taylor & Weber

(57) ABSTRACT

A coin depositing and dispensing machine that enables reduction of the space required to be provided above the coin passage in order to transport coins, thereby enabling the machine body to be made more compact, or increasing the coin accommodating capacity of the accommodating and ejecting units by the amount equivalent to the volume of the reduction of the space. An endless transporting belt is provided above an identifying passage and a sorting passage. The transporting belt is stretched across a plurality of pulleys rotatably supported in a horizontal position by vertically extending shafts. As the space required to be provided above the coin passage to install the transporting belt can be reduced, it is possible to make the machine body more compact, or increase the coin accommodating capacity of the accommodating and ejecting units by the amount equivalent to the volume of the reduction of the space.

13 Claims, 6 Drawing Sheets

(51) Int. Cl.

| | |
|---|---|
| ***G07D 1/02*** | (2006.01) |
| ***G07D 3/14*** | (2006.01) |
| ***G07D 9/00*** | (2006.01) |

(56) References Cited

U.S. PATENT DOCUMENTS

| | | | | |
|---|---|---|---|---|
| 5,899,804 | A * | 5/1999 | Chiba et al. | 453/11 |
| 5,915,525 | A * | 6/1999 | Baker et al. | 198/817 |
| 5,989,118 | A * | 11/1999 | Chiba et al. | 453/11 |
| RE37,471 | E * | 12/2001 | Jagger | 53/282 |
| 6,592,446 | B1 * | 7/2003 | Zimmermann | 453/56 |
| 6,648,747 | B1 * | 11/2003 | Zimmermann | 453/9 |
| 6,783,452 | B2 * | 8/2004 | Hino et al. | 453/3 |
| 7,112,130 | B2 | 9/2006 | Nishimura et al. | |
| 2005/0092585 | A1 * | 5/2005 | Nelson et al. | 198/844.1 |
| 2006/0019591 | A1 | 1/2006 | Abe et al. | |
| 2006/0040603 | A1 | 2/2006 | Nishimura et al. | |
| 2006/0113161 | A1 * | 6/2006 | Umeda | 194/302 |
| 2006/0183418 | A1 * | 8/2006 | Umeda | 453/12 |

FOREIGN PATENT DOCUMENTS

| | | | |
|---|---|---|---|
| JP | 07-152945 | A | 6/1995 |
| JP | 2520891 | Y2 | 10/1996 |
| JP | 11-328485 | A | 11/1999 |
| JP | 2001-067516 | A | 3/2001 |
| JP | 2002-150373 | | 5/2002 |
| JP | 3325678 | B2 | 7/2002 |
| JP | 2003-44895 | | 2/2003 |
| JP | 2005-062995 | A | 3/2005 |
| JP | 2005-128786 | | 5/2005 |

OTHER PUBLICATIONS

Office Action of JP 2006-103419 (with English Translation)—5 pages, dated Feb. 1, 2012).

Office Action of JP 2006-103420 (with English Translation)—4 pages, dated Feb. 1, 2012).

Office Action of JP 2006-103421 (with English Translation)—4 pages, dated Feb. 1, 2012).

* cited by examiner

COIN DEPOSITING AND DISPENSING MACHINE

CROSS REFERENCE TO RELATED APPLICATION

This is a U.S. national phase application under 35 U.S.C. §371 of International Patent Application No. PCT/JP2007/057180, filed Mar. 30, 2007 and claims the benefit of Japanese Application No. 2006-103418, filed Apr. 4, 2006; Japanese Application No. 2006-103419, filed Apr. 4, 2006; Japanese Application No. 2006-103420, filed Apr. 4, 2006 and Japanese Application No. 2006-103421, filed Apr. 4, 2006. The International Application was published in Japanese on Oct. 11, 2007 as International Publication No. WO 2007/114361 under PCT Article 21(2), and all preceding applications are incorporated herein in their entirety.

DESCRIPTION

The present invention relates to a coin depositing and dispensing machine for depositing and dispensing coins.

BACKGROUND OF THE INVENTION

Coin depositing and dispensing machines, electrically connected to cashier equipment, such as a POS cash register, an electronic cash register, or a teller management machine, and enabling depositing and dispensing of cash to be performed automatically according to electrical signals from such cashier equipment, have already been developed for performing cash transactions with customers accurately and rapidly at a cash register in a store or, in a case of a financial institution, at a counter or the like.

In such a conventional coin depositing and dispensing machine, a coin acceptance port that is capable of receiving a plurality of coins simultaneously is provided on the upper front face of the machine body, and a feeding belt for feeding the coins further back into the machine body is provided at the bottom of the coin acceptance port and extends along a side face of the machine body. The feeding belt leads to a coin passage, which is formed in an L-like shape comprised of an identifying passage and a sorting passage extending continuously from the identifying passage. The identifying passage serves to transport coins fed by the feeding belt further back into the machine body. The sorting passage is provided in a back area and extends in a widthwise direction of the machine body so as to change the transporting direction of the coins. The sorting passage is provided with denomination-specific sorting holes, which are arranged along the length of the sorting passage and serve to sort coins based on their denominations.

Conveyor belts for transporting coins including a first transporting belt, a second transporting belt, and a third transporting belt are provided above the coin passage, which is comprised of the identifying passage and the sorting passage. The first transporting belt is laid across a first pulley, which is rotatably provided above a feeding end of the feeding belt, and a second pulley, which is rotatably provided at the middle of the identifying passage. The second transporting belt is laid across the second pulley and a third pulley, which is rotatably provided immediately behind a corner portion in the back area of the machine body. The third transporting belt is laid across the third pulley and a fourth pulley, which is rotatably provided at the terminal end portion of the sorting passage. These pulley are rotatably supported by horizontal shafts so that the pulleys are vertically positioned, perpendicular to the bottom face of the coin passage (e.g. See Japanese Utility Model Registration No. 2520891 (pages 2-3, and FIGS. 1 and 2) ("JP '891").

Furthermore, conventionally known examples of a method of transporting coins in a coin passage include a protrusion-equipped transporting belt method using a transporting belt that is provided with transporter protrusions. According to this protrusion-equipped transporting belt method, a rotating disk is tilted at a predetermined angle with respect to a horizontal direction; a coin passage is connected at a starting end thereof to the upper part of the rotating disk and tilted at the same angle as that of the rotating disk; and a transporting belt provided with protrusions is stretched along the coin passage by pulleys that rotate in parallel with a coin transporting face of the coin passage. Coins are pooled between the rotating disk and a hopper provided at a top face side of the rotating disk. And by synchronously rotating the rotating disk and the transporting belt, one coin at a time is picked up and delivered to a transporter protrusion of the transporting belt by a picking-up member projecting from the top face of the rotating disk, and the picked-up coin is transported by the transporter protrusion pushing the rim of the coin (e.g. See Japanese Patent No. 3325678 (pages 3-4, and FIG. 10) ("JP '678").

SUMMARY OF THE INVENTION

With regard to coin depositing and dispensing machines used in coin register change machines for stores and at counters of financial institutions, there has been an increasing demand for making coin depositing and dispensing machines even more compact.

However, in a coin depositing and dispensing machine described in JP '891, because the pulleys for supporting the transporting belts of the coin passage are rotatably supported by horizontal shafts so that the pulleys are vertically positioned, perpendicular to the bottom face of the coin passage, it is necessary to secure a space from the bottom face of the coin passage with a height that, at a minimum, corresponds to the sum of the thickness of the belt and the diameter of the pulleys. This necessity of securing a large space above the coin passage contributes to making the height of the machine body relatively tall.

According to a protrusion-equipped transporting belt method described in JP '678, the transporting belt is stretched across pulleys that rotate in parallel with the coin transporting face of the coin passage. Therefore, compared with a transporting method using transporting belts employed by a coin depositing and dispensing machine of JP '891, the method of JP '678 enables the space above the coin passage to be narrower in the dimension vertical to the coin transporting face. However, there is also a problem with this method in that using a rotating disk positioned in a tilted state in a feeding mechanism requires a disproportionately large space in height and depth with respect to the sizes of coins to be handled, and is therefore not suitable to serve as a feeding unit of a compact coin register change machine for a store or a coin depositing and dispensing machine at a counter of a financial institution.

In order to solve the above problems, an object of the invention is to provide a coin depositing and dispensing machine that enables reduction of the space required to be provided above the coin passage in order to transport coins, thereby enabling the machine body to be made more compact; or, increasing the coin accommodating capacity of the accommodating and ejecting units by the amount equivalent to the volume of the reduction of the space.

A coin depositing and dispensing machine according to the present invention includes a feeding mechanism for receiving coins that have been input into a coin input port and feeding the received coins one at a time; an identifying passage for identifying the denomination of each coin fed from the feeding mechanism; a sorting passage extending continuously from the identifying passage and serving to sort coins; a transporting unit provided with a plurality of rotating elements rotatably supported by vertically extending shafts, an endless transporter stretched above the identifying passage and the sorting passage by the rotating elements, and a plurality of protrusions protruding downward from the transporter and serving to transport by pushing coins one at a time; a delivery unit for receiving coins from the feeding mechanism and delivering the received coins one at a time to the protrusions of the transporter; and an accommodating and ejecting unit provided below the sorting passage and serving to accommodate coins sorted in the sorting passage and to eject accommodated coins.

The coin depositing and dispensing machine of the present invention has a feeding mechanism that includes a receiving and accommodating unit for receiving and accommodating, in a non-aligned state, coins that have been input into the coin input port; a feeding belt extending along the front end of the machine body in the widthwise direction of the machine body and serving as the bottom face of the receiving and accommodating unit, the feeding belt forming a coin feeding path having a feeding end at which the feeding belt is connected to the delivery unit and the starting end of the identifying passage; and a separation roller disposed above a location near the feeding end of the coin feeding path of the feeding belt and adapted to be rotated in the direction opposite to the coin feeding direction of the feeding belt so that coins on the feeding belt in a non-aligned state become aligned and are fed in a single layer in single file.

The coin depositing and dispensing machine according to the present invention has an identifying passage that extends along the front end of the machine body in the widthwise direction of the machine body so that coins are carried in the identifying passage in the direction opposite to the coin feeding direction of the feeding mechanism.

The coin depositing and dispensing machine of the present invention has a plurality of sorting holes for sorting coins provided in the bottom face of the sorting passage; at least the sorting holes that are not located at the downstream-most side with respect to the coin transporting direction are respectively provided with a sorting gate operable by an electric driving unit; and each sorting gate is adapted to be opened or closed based on the result of identification of the denomination of a coin in the identifying passage so that coins are sorted into the sorting holes allocated to the respective denominations of the coins by opening the corresponding sorting gates.

The coin depositing and dispensing machine of the present invention also has a sorting hole located at the downstream-most side with such a dimension as to limit the coins that fall through to coins with the smallest diameter.

The coin depositing and dispensing machine of the present invention also has a coin depositing and delivery unit that includes a pushing portion for pushing the rim of a coin fed from the feeding mechanism and thereby delivering the coin to a protrusion of the transporter; and a restraining portion for separating a succeeding coin from the coin that is being delivered and holding back the succeeding coin until a succeeding delivery.

The coin depositing and dispensing machine of the present invention also has a feeding mechanism that extends along the front end of the machine body in the widthwise direction of the machine body; the identifying passage extends continuously from the feeding mechanism along the front end of the machine body in the widthwise direction of the machine body so that coins are carried in the identifying passage in the direction opposite to the coin feeding direction of the feeding mechanism; the sorting passage extends continuously from the identifying passage, in the direction going towards the back of the machine body; and a plurality of accommodating and ejecting units are provided below the sorting passage in such a manner as to be juxtaposed in the direction going towards the back of the machine body.

The coin depositing and dispensing machine of the present invention further has each accommodating and ejecting unit provided with an ejecting belt serving as the bottom face of the accommodating and ejecting unit adapted to receive and accommodate coins in a non-aligned state; and a reverse roller disposed above a location near the ejecting end of the ejecting path of the ejecting belt and adapted to be rotated in the direction opposite to the coin ejecting direction of the ejecting belt so that coins on the ejecting belt in a non-aligned state become aligned and are fed in a single layer in single file.

The coin depositing and dispensing machine of the present invention also has a sorting passage that extends in the direction going towards the back of the machine body so as to pass through the central areas of the accommodating and ejecting units.

The coin depositing and dispensing machine of the present invention further has an identifying passage that extends in the direction opposite to the coin feeding direction of the feeding mechanism and then, at a location near a side face of the machine body, the identifying passage changes the coin transporting direction and is connected to the sorting passage; and the identifying passage includes a rejected coin diverting portion for diverting a rejected coin based on the result of identification of the denomination of the coin, the rejected coin diverting portion being provided at a location near the side face of the machine body.

The coin depositing and dispensing machine of the present invention also has a feeding mechanism that includes a feeding belt laid across a plurality of rollers supported by horizontally extending shafts so that the feeding belt slants upward from the upstream side to the downstream side with respect to the feeding direction, the feeding belt having a bent portion formed between the upstream side and the downstream side of the feeding belt so that the inclination angle of the feeding belt changes at the bent portion; a feeding belt guide for supporting, from below, the feeding belt excluding the portion at which the bent portion is located; a separation roller provided above the feeding belt, at a location upstream of the bent portion with respect to the feeding direction, and facing the feeding belt at such a distance therefrom as to enable passage of only a single coin, thereby aligning coins into a single layer in single file; a regulating member provided above and facing the bent portion of the feeding belt at such a distance therefrom as to enable passage of only a single coin; and a movable support for supporting the bent portion of the feeding belt from below in such a manner as to permit the feeding belt to sag downward as a result of the bent portion being pushed by a coin that is being fed while the regulating member guides the coin.

The coin depositing and dispensing machine of the present invention also has movable support in the form of a roller rotatable in the feeding direction of the feeding belt.

The coin depositing and dispensing machine of the present invention further has a stopping unit for forcibly stopping feeding of a coin even when the feeding belt is in operation is provided at the downstream side of the feeding belt with respect to the feeding direction; and the regulating member is provided above and faces an area of the feeding belt extending from the bent portion to the stopping unit, at such a distance from the feeding belt as to enable passage of only a single coin.

The coin depositing and dispensing machine of the present invention provides an endless transporter above the identifying passage and the sorting passage in such a manner that the transporter is stretched across a plurality of rotating elements rotatably supported by vertically extending shafts reduces the space required to be provided above the passages to install the transporter. As a result of this arrangement, it is possible to make the machine body more compact in height, or increase the coin accommodating capacity of the accommodating and ejecting unit by the amount equivalent to the volume of the reduction of the space.

With the coin depositing and dispensing machine of the present invention, the feeding mechanism has a structure that includes a feeding belt and a separation roller. Therefore, the present invention enables the feeding mechanism to be made more compact than a conventional mechanism that uses a rotating disk.

With the coin depositing and dispensing machine of the present invention, the identifying passage extends along the front end of the machine body in the widthwise direction of the machine body so that coins are carried in the identifying passage in the direction opposite to the coin feeding direction of the feeding mechanism. Therefore, the present invention enables reduction of the dimension of the feeding mechanism and the identifying passage in the depth direction of the machine body, and thereby makes it possible to make the machine body more compact in depth, or increase the coin accommodating capacity of the accommodating and ejecting unit by the amount equivalent to the volume of the reduction of the space.

With the sorting passage of the coin depositing and dispensing machine of the present invention, each sorting gate is operable by an electric driving unit that is adapted to be opened or closed based on the result of identification of the denomination of a coin in the identifying passage so that coins are sorted into the sorting holes allocated to the respective denominations of the coins by opening the corresponding sorting gates. Therefore, the present invention enables accurate sorting of coins. Furthermore, unlike the sorting of coins based on their sizes by unit of sorting holes provided for different coin diameters, the sorting holes according to the present invention may be allocated for any desired denominations of coins: for example, by allocating a denomination that starts with the numeral "1" to a sorting hole located closer to the front of the machine body and allocating a denomination that starts with the numeral "5" to a sorting hole located closer to the back of the machine body, it is possible to reduce the distance between an accommodating and ejecting unit for a frequently dispensed denomination and the location to which a coin is released, and thereby reduce the dispensing processing time. Moreover, it is also possible to allocate a plurality of denominations to a single accommodating and ejecting unit so that the accommodating and ejecting unit also handles a denomination to be excluded from the dispensing process and/or a denomination for which the corresponding accommodating and ejecting unit is filled up with coins. As a result, the number of recovery operations for coins from the accommodating and ejecting units can be reduced, thereby enabling long-term nonstop operation of the coin depositing and dispensing machine. Furthermore, as a sorting hole at the downstream-most side with respect to the transporting direction may be formed so as to enable sorting based on a shape or dimension of a coin, it is possible to eliminate an electrical driving unit and a sorting gate to be operated thereby and consequently reduce production costs of the machine of the present invention.

With the coin depositing and dispensing machine of the present invention, by forming a sorting hole at the downstream-most side with respect to the transporting direction to have such a dimension as to limit the coins that fall through to coins with the smallest diameter, it is possible to ensure that no coins other than those having the smallest diameter are permitted to fall through the sorting hole into the accommodating and ejecting unit. As a result of this aspect, even if the machine stops operation in a state where coins remain in the sorting passage due to depositing or transport trouble or any other reasons, there is no possibility of a user or anyone else who is manually removing the remaining coins accidentally dropping a coin with a diameter greater than the smallest diameter into the sorting hole located at the downstream-most side with respect to the transporting direction. Therefore, the present invention better prevents cash-related irregularities resulting from intermingling of coins of different denominations.

With the delivery unit of the coin depositing and dispensing machine of the present invention, a coin fed from the feeding mechanism is reliably delivered to a protrusion of the transporter by the pushing portion of the delivery unit pushing the rim of the coin, and a succeeding coin fed from the feeding mechanism is separated and held back by the restraining portion of the delivery unit until the time for the next delivery. Therefore, the present invention enables accurate delivery of coins, one at a time, to the protrusions of the transporter.

With the coin depositing and dispensing machine of the present invention, arranging the feeding mechanism and the identifying passage along the front end of the machine body in the widthwise direction of the machine body enables reduction of the dimension of the feeding mechanism and the identifying passage in the depth direction of the machine body, so that a space can be secured in the back of the machine body. Furthermore, arranging the sorting passage and the plurality of accommodating and ejecting units along the direction of the depth of the machine body makes it possible to increase the coin accommodation capacity by using the secured space to increase the dimension of each accommodating and ejecting unit in the depth direction of the machine body. Therefore, the present invention enables the capacity of accommodating coins to be increased without making the machine body larger.

With the coin depositing and dispensing machine of the present invention, coins are received on the ejecting belt, which forms the bottom face of each accommodating and ejecting unit, and ejection of coins is performed in such a manner that coins on the ejecting belt in a non-aligned state are aligned into a single layer in single file by the reverse roller rotated in the direction opposite to the direction the ejecting belt is ejecting coins. Therefore, the present invention enables an increase of coin accommodation capacity, as well as reliable ejection of coins one at a time.

With the coin depositing and dispensing machine of the present invention, the sorting passage extends in the direction going towards the back of the machine body so as to pass through the central area of the accommodating and ejecting units. Therefore, the present invention enables the coins sorted in the sorting passage to fall to the central area of the accommodating and ejecting units and thereby facilitates the coins to be distributed throughout the accommodating and ejecting units. As a result, the capacity of accommodating coins can be increased without making the machine body larger.

With the coin depositing and dispensing machine of the present invention, the identifying passage extends in the direction opposite to the coin feeding direction of the feeding mechanism and then, at a location near a side face of the machine body, the identifying passage changes the coin feeding direction and is connected to the sorting passage; and, in the proximity of the side face of the machine body, the identifying passage is provided with a rejected coin diverting portion for diverting a rejected coin. Therefore, the present invention facilitates removal of rejected coins from the front of the machine body.

With the coin depositing and dispensing machine of the present invention, a regulating member is provided above the bent portion of the feeding belt at such a distance therefrom as to enable passage of only a single coin, and a movable support is provided to support the bent portion of the feeding belt from below in such a manner as to permit the feeding belt to sag downward as a result of the bent portion being pushed by a coin that is being transported while the regulating member guides the coin so that only one coin at a time is enabled to pass the bent portion. Therefore, the present invention is capable of reducing faulty transport by preventing an overlapping of coins at the bent portion of the feeding belt.

With the coin depositing and dispensing machine of the present invention, the movable support is a roller rotatable in the coin feeding direction of the feeding belt. Therefore, the present invention enables smooth rotation of the feeding belt, because contact between the feeding belt and the roller produces little friction.

With the coin depositing and dispensing machine of the present invention, the regulating member is provided above and faces an area of the feeding belt extending from the bent portion to the stopping unit. Therefore, the present invention reduces faulty transport of coins by preventing an overlapping of coins at the bent portion of the feeding belt, although a stopping unit for forcibly stopping feeding of a coin even when the feeding belt is in operation is provided at the downstream side of the feeding belt with respect to the coin feeding direction.

DETAILED DESCRIPTION OF THE INVENTION

Figure 1:
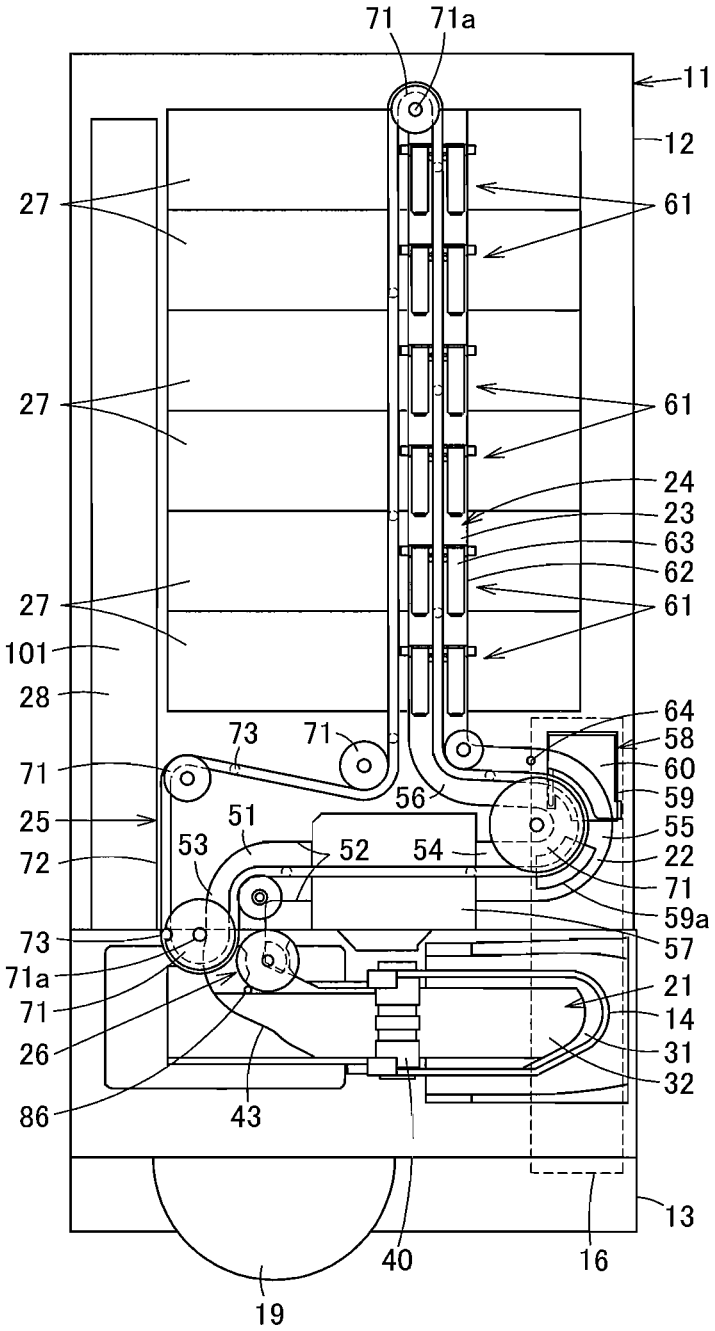
FIG. 1 is a plan view of an internal structure of a coin depositing and dispensing machine according to an embodiment of the present invention.

In the explanation hereunder, the terms "the right side" and "the left side" refer to "the right side" and "the left side" respectively as viewed in FIG. 1, unless indicated otherwise.

Figure 7:
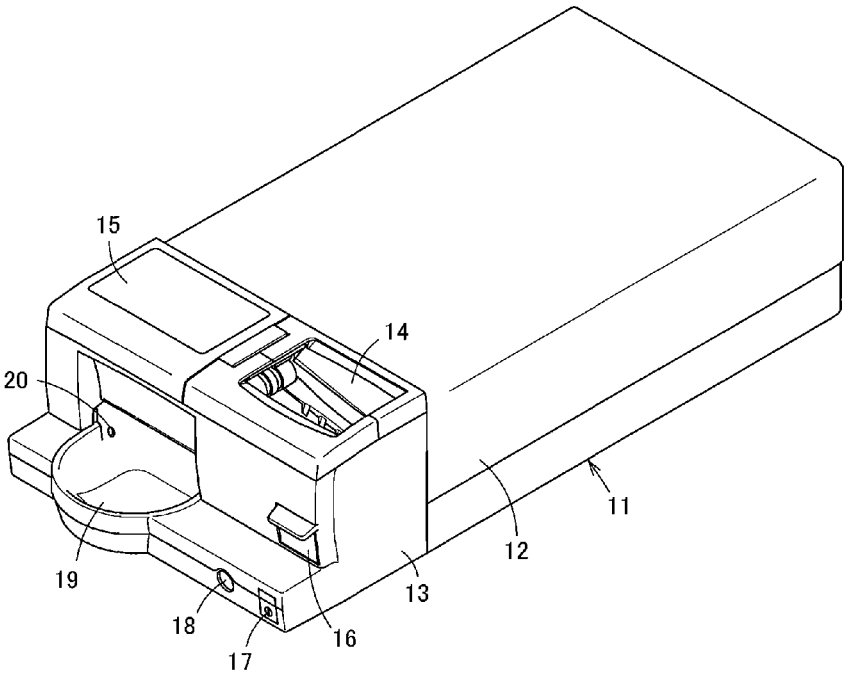
FIG. 7 is a perspective view of the coin depositing and dispensing machine.

FIG. 7 is a perspective view of a coin depositing and dispensing machine, which may be installed, for example, at a cash register in a store and electrically connected to and used in conjunction with a POS cash register to enable depositing and dispensing of cash to be performed automatically.

The coin depositing and dispensing machine has a machine body 11 provided with a frame 12, which is open at the front end, and a body unit 13, which can be pulled from the front end of the frame 12. The width of the machine body 11 is the lateral dimension of the front face of the machine body 11 and approximately a half of the width of the POS cash register, so that the coin depositing and dispensing machine can be used in combination with a bank note depositing and dispensing machine that has approximately the same width as the coin depositing and dispensing machine.

The anterior area of the body unit 13 projects from the frame 12 of the machine body 11. On one of the widthwise sides of the machine body 11, to be more specific, on the right side of the body unit 13, a coin input port 14 for accepting coins is provided at the top of the anterior area of the machine body 11, and an operation and display unit 15 for performing operation and display is provided on the other widthwise side of the machine body 11, i.e. the left side of the body unit 13.

Provided on the right side of the front face of the anterior part of the body unit 13 are a reject box 16 for receiving rejected coins, as well as a power supply switch 17 and a lock 18 of the coin depositing and dispensing machine. The lock 18 serves to lock the body unit 13 in the frame 12 in such a state that the aforementioned anterior part of the body unit 13 is exposed from the frame 12. The reject box 16 can be pulled from the body unit 13. A release tray 19 for receiving coins dispensed from the machine body is provided on the left side of the front face of the anterior part of the body unit 13. The release tray 19 is provided with a full-state sensor 20 for detecting whether the release tray 19 has reached a full state, i.e. the state where the release tray 19 has become filled up with released coins.

FIG. 1 represents a plan view of the internal structure of the coin depositing and dispensing machine, including a feeding mechanism 21, a coin passage 24, a transporting unit 25, a delivery unit 26 that serves as a stopping unit, denomination-specific accommodating and ejecting units 27, and a dispensing and transporting unit 28. The feeding mechanism 21 is provided in the anterior area of the machine body 11 and extends along the front end of the machine body 11, in the widthwise direction of the machine body 11. The coin passage 24 has an identifying passage 22 and a sorting passage 23. The identifying passage 22 extends continuously from the feeding mechanism 21 in the widthwise direction of the machine body 11. In the identifying passage 22, coins are carried in the direction opposite to the coin feeding direction of the feeding mechanism 21. The sorting passage 23 extends continuously from the identifying passage 22, in the direction going towards the back of the machine body 11. The transporting unit 25 serves to transport coins in the coin passage 24. The delivery unit 26 serves to singly deliver to the transporting unit 25 coins fed from the feeding mechanism 21. The accommodating and ejecting units 27 are provided below the sorting passage 23 in such a manner as to be juxtaposed in the front-to-back direction of the machine body 11. The dispensing and transporting unit 28 is disposed to the left of the accommodating and ejecting units 27 and extends along the front-to-back direction, along the left side face of the machine body 11.

Figure 2:
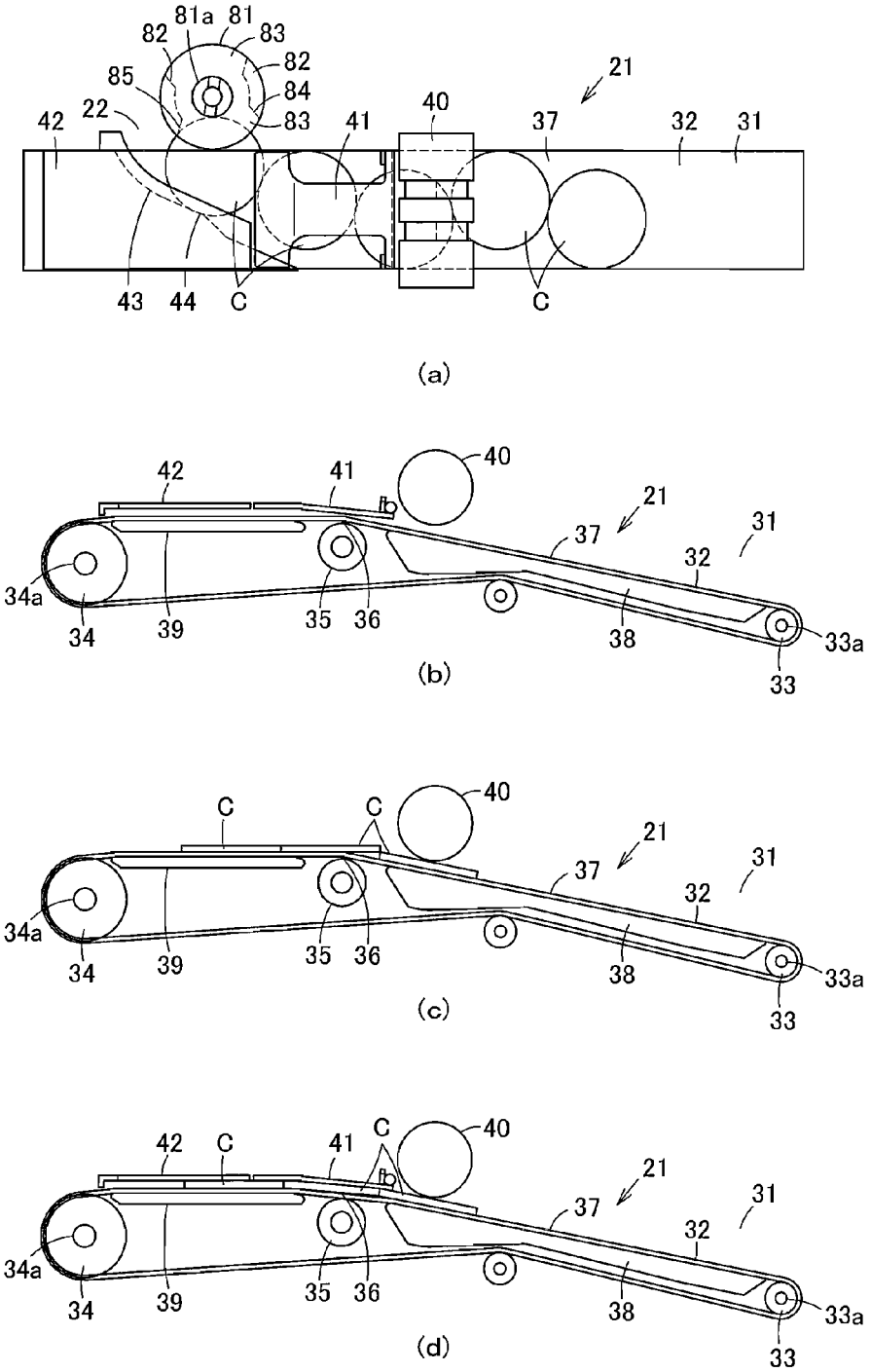
FIG. 2 illustrates a feeding mechanism of the aforementioned coin depositing and dispensing machine, wherein (a) is a plan view; (b) is a front view; (c) is a front view illustrating how a coin is fed in a case where the feeding mechanism is not provided with a regulating member; and (d) is a front view showing how a coin is being fed in a case where the feeding mechanism is provided with regulating members.

As illustrated in FIGS. 1 and 2, the feeding mechanism 21 has a receiving and accommodating unit 31 and a feeding belt 32, which extends in a widthwise direction of the machine body 11 and forms the bottom face of the receiving and accommodating unit 31. The receiving and accommodating unit 31 is provided below the coin input port 14 and serves to receive and accommodate coins that have been input into the coin input port 14. The coins are indicated in the drawings by the symbol C, which is to be omitted hereinafter, and are received and accommodated by the receiving and accommodating unit 31 in a non-aligned state.

The feeding belt 32 is formed of a flat endless belt. Across a plurality of rollers including two end rollers 33,34 respectively supported by horizontal shafts 33*a*,34*a*, the feeding belt 32 is laid so as to slant upward from the right side towards the left side, in other words from the upstream side upward to the downstream side with respect to the transporting direction. A roller 35 serving as a movable support is provided to form a bent portion 36 between the upstream side and the downstream side with respect to the transporting direction so that the inclination angle of the feeding belt 32 changes at the bent portion 36. The upper surface of the feeding belt 32 constitutes a transporting surface 37 on which coins are transported. The upstream area from the bent portion 36 of the transporting surface 37 with respect the transporting direction is formed as a slanted face tilted upward, and the downstream area of the transporting surface 37 is formed as a horizontal face. The passage for coins on the feeding belt 32 has a width greater than the diameter of the largest coin among the coins to be handled and smaller than twice the diameter of the smallest coin.

Disposed below the upper face portion, which constitutes the transporting surface 37, of the feeding belt 32 are feeding belt guides 38,39 for supporting, from below, the part of the transporting surface 37 excluding the bent portion 36.

A separation roller 40 is disposed above the feeding belt 32, at a location upstream of the bent portion 36 of the feeding belt 32 with respect to the transporting direction. The separation roller 40 faces the feeding belt 32, at such a distance therefrom as to enable passage of only a single coin. The separation roller 40 is adapted to be rotated in the direction opposite to that which the feeding belt 32 is feeding coins so that coins on the feeding belt 32 in a non-aligned state become aligned and are fed in a single layer in single file.

Regulating members 41,42 are respectively disposed above the bent portion 36 of the feeding belt 32 and above the portion of the feeding belt 32 downstream of the bent portion 36 with respect to the transporting direction, and face the feeding belt 32, at such a distance therefrom as to enable passage of only a single coin.

At a location downstream of the bent portion 36 of the feeding belt 32 with respect to the transporting direction, a guide portion 43 is provided below the regulating members 41,42 so that the rim of a coin on the feeding belt 32 comes into contact with the guide portion 43 and is guided towards the starting end of the identifying passage 22. Formed at some point along the length of the guide portion 43 is a guide protrusion 44 for enabling a coin whose rim has come into contact with the guide portion 43 to move towards the starting end of the identifying passage 22 ahead of any subsequent coins.

Figure 3:
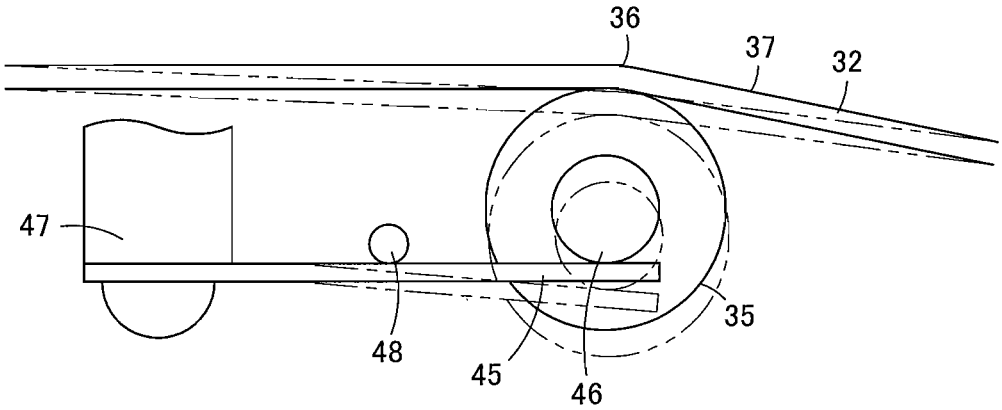
FIG. 3 is a front view of a support mechanism of a movable support of the aforementioned coin depositing and dispensing machine.

The roller 35 supporting the bent portion 36 of the feeding belt 32 from below permits the feeding belt 32 to sag downward as a result of being pushed by a coin that is being transported through the bent portion 36 of the feeding belt 32 with the regulating member 41 guiding the coin. As illustrated in FIG. 3, the roller 35 is supported in such a manner as to be capable of moving vertically, while the roller 35 is biased upward by a plate spring 45, which serves as a biasing unit. To be more specific, the roller 35 is supported by a horizontally extending shaft 46 so as to be capable of rotating in the transporting direction of the feeding belt 32. The shaft 46 is fixed to the distal end, i.e. the free end, of the plate spring 45. The base end of the plate spring 45 is attached to a fixed portion 47, which is fixed to the feeding belt guide 39 so that the spring force of the plate spring 45 is constantly applied to the roller 35, pushing the roller 35 upward. The upward movement of the roller 35 is restricted by contact of the plate spring 45 with a stopper 48. At an elevated position of the roller 35, where the plate spring 45 is in contact with the stopper 48, the distance between the bent portion 36 of the feeding belt 32 and the regulating member 41 is smaller than the thickness of any coin to be handled.

As illustrated in FIG. 1, the coin passage 24 is disposed in a horizontal orientation and has a passage face portion 51 and passage side face portions 52. The passage face portion 51 extends along the entire length of the identifying passage 22 and the sorting passage 23 and is formed of a horizontal surface that one face or other of a coin is in contact, and the passage side face portions 52 are respectively arranged along the two opposing sides of the passage face portion 51. The width of the coin passage 24 is the distance between the two opposing passage side face portions 52 and is greater than the diameter of the largest coin among the coins to be handled and smaller than twice the diameter of the smallest coin.

The identifying passage 22 has a first return passage portion 53, an identifying passage portion 54 extending continuously from the first return passage portion 53, a second return passage portion 55 extending continuously from the identifying passage portion 54, and a curved passage portion 56 extending continuously from the second return passage portion 55. At the starting end portion thereof, the identifying passage 22 is connected to the feeding mechanism 21, and, immediately at the first return passage portion 53, bends back to the right. The identifying passage portion 54 is located behind the feeding mechanism 21 and extends in parallel with the feeding belt 32 of the feeding mechanism 21. The identifying passage 22 bends back to the left at the second return passage portion 55, and curves again at the curved passage portion 56 towards the sorting passage 23, which is located further in the back of the machine body 11.

The identifying passage portion 54 of the identifying passage 22 is provided with a coin identifying unit 57 for identifying the denomination of each coin by recognizing the material, diameter, etc. of each coin.

The second return passage portion 55 of the identifying passage 22 is located near the right side face of the machine body 11 and provided with a reject gate portion 58 serving as a rejected coin diverting portion for diverting a coin that the coin identifying unit 57 has identified as a coin to be rejected. The reject gate portion 58 has a diverting hole 59 that is formed at an area extending from the passage face portion 51 to the passage side face portion 52 at the outer circumferential side of the second return passage portion 55 and has such a dimension as to enable a coin to divert. The diverting hole 59 is provided with a reject gate 60 that also serves as a part of the aforementioned area from the passage face portion 51 to the passage side face portion 52 at the outer circumferential side of the second return passage portion 55. The reject gate 60 is supported pivotally at the end facing towards the rear end of the machine body 11 and adapted to be opened or closed by an electric driving unit (not illustrated), such as a solenoid or a motor. A reject box 16 is provided below the rejected coin diverting portion so that opening the reject gate 60 enables a rejected coin diverted from the diverting hole 59 to be accommodated in the reject box 16.

An elimination port 59*a* through which foreign objects transported to the identifying passage 22 are dropped and removed out of the identifying passage 22 is formed in the second return passage portion 55 of the identifying passage 22, at a location upstream of the reject gate portion 58 with respect to the transporting. An overlap allowance is provided at each lateral edge of the elimination port 59*a* to enable even a coin with the minimum diameter to move over the elimination port 59*a*, thereby preventing the coin from falling through the elimination port 59*a* regardless of whether the coin is being transported along the outer side or the inner side of the second return passage portion 55.

The sorting passage 23 extends from the curved passage portion 56 of the identifying passage 22 in the direction going towards the back of the machine body 11 so as to pass through the middle area of the accommodating and ejecting units 27 with respect to the widthwise direction of the machine body 11. The sorting passage 23 is provided with a plurality of sorting gate units 61 for sorting coins in accordance with the denominations. The sorting gate units 61 are provided at respective sorting positions above the accommodating and ejecting units 27 so as to enable sorted coins to be accommodated in appropriate accommodating and ejecting units 27. Each sorting gate unit 61 is provided with a sorting hole 62 that is formed in the passage face portion 51 to enable a coin to fall therethrough. Each sorting hole 62 is provided with a sorting gate 63 that is rotatably supported at a point downstream of the sorting hole 62 and adapted to be opened or closed by unit of an electric driving unit (not illustrated), such as a solenoid or a motor.

A detecting unit 64 for optically detecting a coin delivered by the transporting unit 25 is provided at the starting end of the sorting passage 23.

The transporting unit 25 has a transporting belt 72 serving as a transporter. The transporting belt 72 is stretched across a plurality of pulleys 71 and adapted to rotatably move along the widthwise middle of the identifying passage 22 and the sorting passage 23. Each pulley 71 serves as a rotating element and is rotatably supported in a horizontal position by a vertically extending shaft 71*a*. A timing belt with a plurality of teeth along the inner circumferential face may be used as the transporting belt 72. If such is the case, timing pulleys with a plurality of teeth around their circumferences are used as the pulleys 71. A distance greater than the thickness of the thickest coin among the coins to be handled is maintained between the transporting belt 72, which is supported by the plurality of pulleys 71, and the passage face portion 51.

The transporting belt 72 is provided with downward protruding protrusions 73 for pushing and transporting coins in the coin passage one at a time. The protrusions 73 are provided at given intervals so that coins are separated from one another with respect to the transporting direction and transported. A distance less than the thickness of the thinnest coin among the coins to be handled is maintained between the passage face portion 51 and the protrusions 73.

Figure 4:
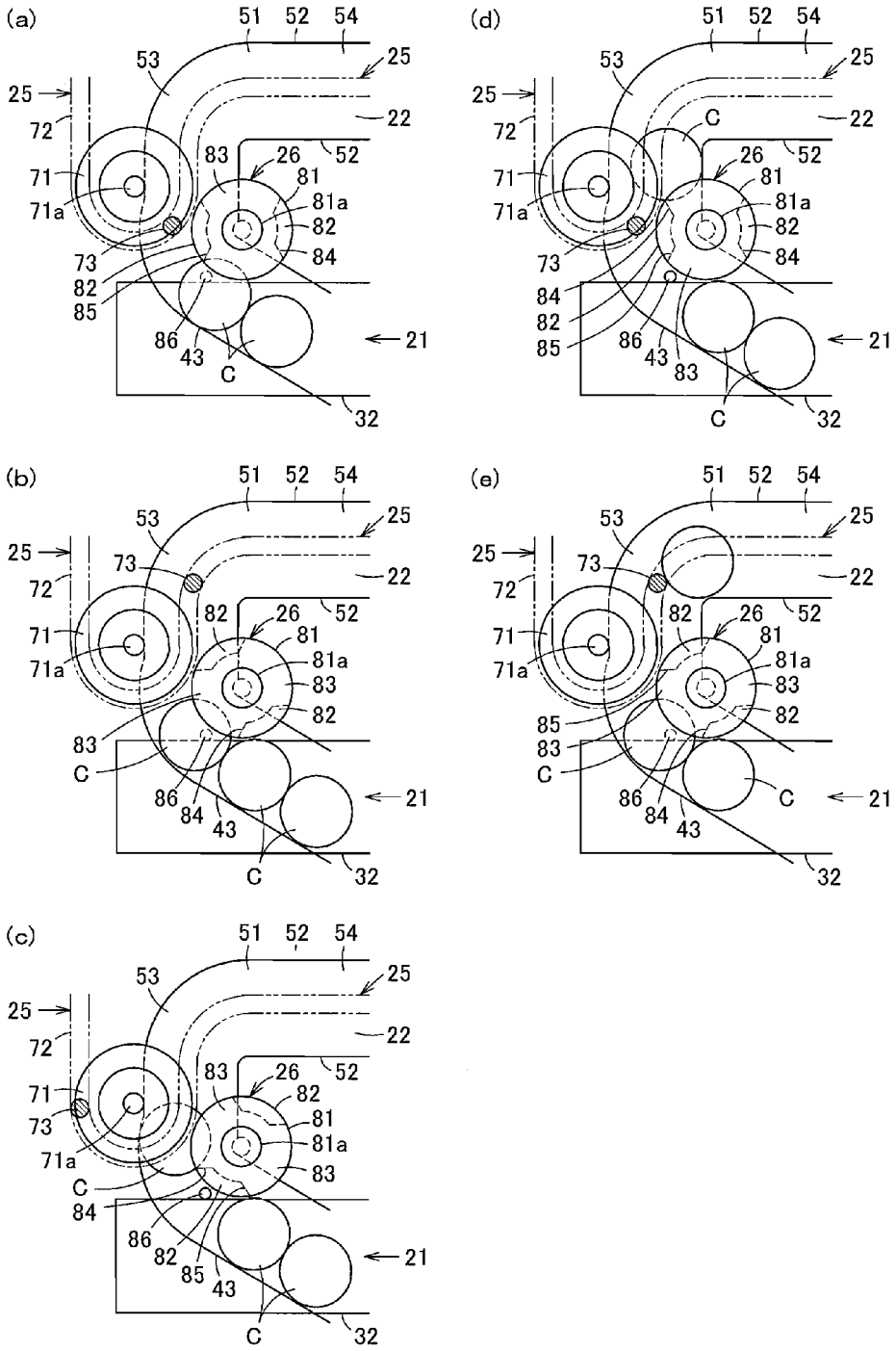
FIG. 4 is a plan view illustrating delivery operation of a delivery unit of the coin depositing and dispensing machine in the order of (a) to (e).

As illustrated in FIGS. 1, 2 and 4, the delivery unit 26 has a circular cam 81 provided at the starting end portion of the identifying passage 22, at which coins fed from the feeding mechanism 21 are received by the identifying passage 22. With respect to the widthwise direction of the identifying passage 22, the cam 81 is located opposite to the guide portion 43, which serves to guide coins from the upper face of the feeding belt 32 to the identifying passage 22. The cam 81 is rotatably supported in a horizontal position by a vertically extending shaft 81*a* and adapted to be rotated by unit of an electric driving unit (not illustrated), such as a pulse motor, in the direction in which coins are delivered, i.e. clockwise as viewed in the drawings.

A pair of projecting portions 82 projecting downward are formed on the lower underside of the cam 81, at circumferentially opposite to locations on the rim of the cam 81. Recesses 83 are formed between the projecting portions 82 in such a manner that each recess 83 is formed between an end of a projecting portion 82 and the opposing end of the other projecting portion 82. The distance between the passage face portion 51 and the projecting portions 82 is small enough to prevent entrance of a coin. The width of each recess 83 provided between the projecting portions 82, as well as the distance between each recess 83 and the passage face portion 51, are large enough to enable entrance of a single coin.

The end portion of each projecting portion 82 facing the rotating direction of the cam 81 serves as a pushing portion 84 for pushing the rim of a coin that has been fed from the feeding mechanism 21 and entered a recess 83, and thereby delivering the coin to a protrusion 73 of the transporting belt 72. The outer circumferential face of each projecting portion 82 and the end portion of each projecting portion 82 facing away from the rotating direction of the cam 81 constitute a restraining portion 85 for separating a succeeding coin from a coin that is being delivered and holding back the succeeding coin until the time for the next delivery.

A detecting unit 86 for optically detecting a coin fed from the feeding mechanism 21 to the identifying passage 22 is provided at a side of the feeding belt 32 of the feeding mechanism 21.

A regular position for the cam 81 is set at a position illustrated in FIG. 4(*a*), at which a coin that has been fed from the feeding mechanism 21 to the identifying passage 22 and entered one of the recesses 83 is stopped upon coming into contact with one of the restraining portions 85. The cam 81 is controlled so as to rotate 180° from the aforementioned regular position to the next regular position at such a timing as to enable the coin to be delivered to a protrusion 73 of the transporting belt 72 based on the position of the protrusion 73. At the aforementioned next regular position, the succeeding coin fed from the feeding mechanism 21 to the identifying passage 22 and entered the other recess 83 is stopped upon coming into contact with the other restraining portion 85, and the cam 81 stands by for the next delivery action.

Figure 5:
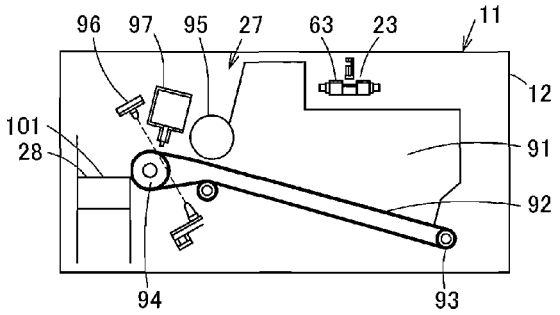
FIG. 5 is a sectional view of an accommodating and ejecting unit of the coin depositing and dispensing machine.

As illustrated in FIG. 5, each accommodating and ejecting unit 27 has an accommodating portion 91 and an ejecting belt 92 constituting the bottom of the accommodating portion 91. The accommodating portions 91 serve to accommodate in a non-aligned state coins dropped therein after being sorted in the sorting passage 23.

Each ejecting belt 92 is a flat endless belt laid across a plurality of rollers so as to slant upward from the right side towards the left side, in other words from the upstream side upward to the downstream side with respect to the ejecting direction. The aforementioned plurality of rollers include two end rollers 93,94 respectively supported by horizontal shafts.

A reverse roller 95 is disposed above an ejecting end of the ejecting path of the ejecting belt 92 and faces the ejecting belt 92, at such a distance therefrom as to enable passage of only a single coin. The reverse roller 95 is adapted to be rotated in the direction opposite to that which the ejecting belt 92 is ejecting coins so that coins on the ejecting belt 92 in a non-aligned state become aligned and are ejected in a single layer in single file.

The ejecting belt 92 is provided with a detecting unit 96 and a stopper 97, at a location between a point facing the reverse roller 95 and the aforementioned ejecting end. The detecting unit 96 serves to detect a coin being ejected from the end of the ejecting belt 92, and the stopper 97 serves to stop succeeding coins from being ejected when a required number of coins have been ejected.

Figure 6:
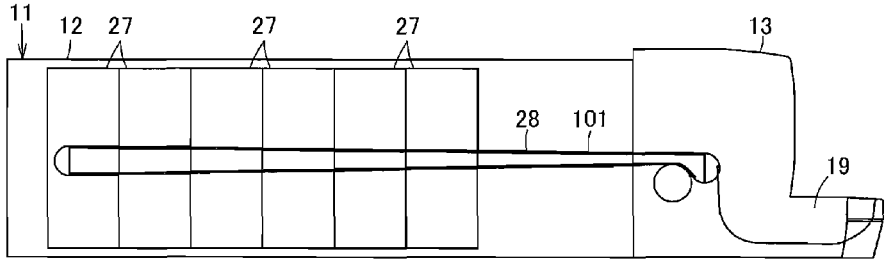
FIG. 6 is a side view of the internal structure of the coin depositing and dispensing machine.

As illustrated in FIGS. 1 and 6, the dispensing and transporting unit 28 has a dispensing and transporting belt 101 that is stretched along the front-to-back direction, along the ejecting end faces of the accommodating and ejecting units 27, so that coins ejected from the accommodating and ejecting units 27 are transported forward on the dispensing and transporting belt 101 to be released into the release tray 19.

Figure 8:
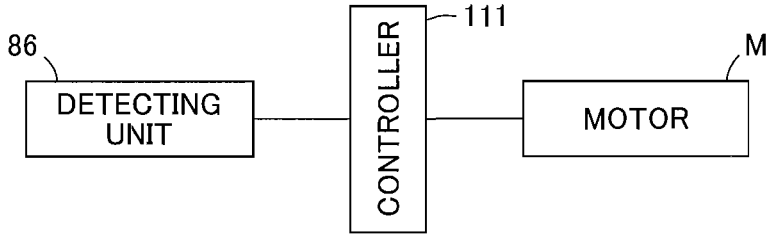
FIG. 8 is a block diagram illustrating control of the delivery unit of the coin depositing and dispensing machine.

A block diagram showing control of the delivery unit is illustrated in FIG. 8. A controller 111 is capable of delivering coins one at a time to the protrusions 73 of the transporting belt 72 by operating a motor M to rotate the cam 81 of the delivery unit 26 based on positional information of the protrusions 73 and information from the detecting unit 86 on detection of a coin fed from the feeding mechanism 21.

Next, the functions of the coin depositing and dispensing machine according to the present embodiment is explained hereunder.

First, a depositing process is explained.

Coins are input from the coin input port 14 into the receiving and accommodating unit 31 of the feeding mechanism 21. As a result of detecting the coins on the feeding belt 32 by unit of a sensor (not illustrated) of the receiving and accommodating unit 31, the feeding belt 32 rotates while the separation roller 40 rotates in the direction opposite to the direction in which the feeding belt 32 rotates so that coins on the feeding belt 32 in a non-aligned state become aligned and fed in a single layer in single file.

As illustrated in FIGS. 2(*a*) and (*d*), the coins that have been aligned into a single layer in single file as a result of passing below the separation roller 40 enter the space under the regulating member 41 one at a time and move towards the downstream side in the feeding direction while pushing the roller 35 downward against the biasing force applied to the roller 35, which supports the bent portion 36 of the feeding belt 32. Then, one coin at a time enters the space under the regulating member 42, at which the rim of the coin comes into contact with the guide portion 43, and moves towards the starting end of the identifying passage 22.

At that time, should there be no regulating member 41 above the bent portion 36 of the feeding belt 32 as is the structure illustrated in FIG. 2(*c*), the rear portion of the coin moving onto the horizontal surface of the feeding belt 32, which is downstream of the bent portion 36 with respect to the feeding direction, becomes lifted from the slanted face, which is upstream of the bent portion 36. This presents the possibility of the succeeding coin entering the space between the lifted coin and the feeding belt 32, resulting in an overlapping of the coins. With such a conventional structure of a coin transporting device, an overlapping of coins on a feeding belt may be prevented by providing a bent portion at two or more locations along the coin feeding path of the feeding belt or providing numerous bent portions in a continuous manner on the feeding belt so that the transporting face is curved (See Japanese Laid-open Patent Publication No. 2004-199154). However, should coins move sluggishly near the exit of the feeding path while the feeding belt is rotating, each lagging coin is often in close contact with its succeeding coin. If such is the case, as no member is provided above the feeding belt to prevent an overlapping of coins, even slight vibration or a deformed coin may upset the balance of the coins, resulting in an overlapping of coins.

However, a coin transporting device having a structure such as the one in the present embodiment is provided with a regulating member 41 above the bent portion 36 of the feeding belt 32 as illustrated in FIGS. 2(*a*) and (*d*), and the roller 35 supports the bent portion 36 of the feeding belt 32 from below in such a manner as to permit the feeding belt 32 to sag downward as a result of the bent portion 36 being pushed by a coin that is being transported while the regulating member 41 guides the coin so that only one coin at a time is enabled to pass the bent portion 36. Therefore, the structure according to the present embodiment is capable of reducing faulty transport by preventing an overlapping of coins at the bent portion 36 of the feeding belt 32.

As the roller 35, which is capable of rotating in the transporting direction of the feeding belt 32 serves as a movable support, contact between the feeding belt 32 and the roller 35 produces little friction, enabling smooth rotation of the feeding belt 32.

The cam 81 of the delivery unit 26 at the starting end portion of the identifying passage 22 stops transport of coins even when the feeding belt 32 is in operation. At that time, however, the regulating members 41,42 extending from the area above the bent portion 36 of the feeding belt 32 to the vicinity of the cam 81 prevent the pressure of the coins from moving the coins upward, thereby preventing an overlapping of coins.

When the cam 81 of the delivery unit 26, which is located at the starting end portion of the identifying passage 22, is at a regular position as illustrated in FIG. 4(*a*), a coin fed from the feeding mechanism 21 comes into contact with the guide portion 43 and moves towards the starting end portion of the identifying passage 22. The coin advances into one of the recesses 83 and is stopped upon coming into contact with a restraining portion 85 of one of the projecting portions 82. At that time, the feeding belt 32 is still rotating. Furthermore, the guide protrusion 44 enables the coin that is in contact with the guide portion 43 to move towards the starting end of the identifying passage 22 ahead of any subsequent coins as illustrated in FIG. 2(*a*), thereby ensuring stable delivery of the coin into the aforementioned recess 83 of the cam 81.

As a result of the detecting unit 86 detecting a coin fed from the feeding mechanism 21 to the identifying passage 22, the cam 81 rotates in a delivery direction based on the position of the corresponding protrusion 73 of the transporting belt 72 at a prescribed timing so as to enable the coin to be delivered to the protrusion 73.

As illustrated in FIG. 4(*b*), when the cam 81 starts to rotate, the other projecting portion 82 advances into the space between the leading coin, i.e. the coin to be delivered first, and the succeeding coin, and the restraining portion 85 that is constituted by the outer circumferential face of this projecting portion 82 prevents the succeeding coin from advancing further.

As illustrated in FIG. 4(*c*), the pushing portion 84 of the aforementioned other projecting portion 82 pushes the leading coin to a point on the identifying passage 22, at which the coin can be delivered to a protrusion 73 of the transporting belt 72.

As illustrated in FIG. 4(*d*), the cam 81 rotates 180° to stop at the other regular position.

As illustrated in FIG. 4(*e*), a protrusion 73 of the transporting belt 72 pushes and thereby transports a coin in the identifying passage 22. The succeeding coin advances into the other recess 83, and the detecting unit 86 detects this succeeding coin. As a result, the cam 81 rotates in a delivery direction based on the position of the succeeding protrusion 73 of the transporting belt 72 at a prescribed timing so as to enable the coin to be delivered to this succeeding protrusion 73.

As described above, a coin fed from the feeding mechanism 21 is delivered to a protrusion 73 of the transporting belt 72 by a pushing portion 84 of the cam 81 pushing the rim of the coin, and the succeeding coin fed from the feeding mechanism 21 is separated and held back by a restraining portion 85 of the cam 81 until the time for the next delivery action. Thus, the cam 81 is capable of reliably delivering the coins one at a time to the protrusions 73 of the transporting belt 72. As a result, the structure of the invention is capable of preventing a foreign object input from the coin input port 14 and fed together with coins by the feeding mechanism 21 from entering the coin passage 24. Furthermore, even if such a foreign object is inadvertently fed into the coin passage, the elimination port 59*a* through which foreign objects fall and are thereby removed prevents the foreign object from further moving to the downstream side in the transporting direction. Therefore, faulty transport is reduced. Furthermore, employing the cam 81 not only enables coins fed from the feeding mechanism 21 to be reliably delivered to the protrusions 73 of the transporting belt 72 one at a time, regardless of the structure of the feeding mechanism 21 or of the coin passage 24, but also provides a compact coin feeding device by making the feeding mechanism 21 and the coin passage 24 more compact.

As delivery of coins is performed by rotation of the circular cam 81, which is provided with at least two each pushing portions 84 and restraining portions 85 on the circumference of the cam 81, smooth delivery of coins is ensured.

Furthermore, each coin transported in the identifying passage 22 by being pushed by a protrusion 73 of the transporting belt 72 undergoes identification of its denomination by the coin identifying unit 57.

Rejected coins, which could not be identified or were otherwise determined as coins to be rejected by the identification process, are diverted at the reject gate portion 58 and stored in the reject box 16. The rejected coins can be recovered by pulling the reject box 16 from the machine body 11.

The reject gate portion 58 is provided at the second return passage portion 55, which extends in a direction opposite to the coin feeding direction of the feeding mechanism 21 and then, at a location near the right side face of the machine body 11, the second return passage portion 55 changes the coin feeding direction and is connected to the sorting passage 23. As the reject box 16 is disposed near the right side face of the machine body 11, it is easy to accommodate rejected coins in the reject box 16 and also easy to remove the rejected coins from the front of the machine body 11.

Coins identified to be authentic by the identification process pass through the reject gate portion 58 and are detected by the detecting unit 64. Thereafter, the coins are transported in the sorting passage 23. As it is possible to ascertain a location of each coin with respect to the transporting path in the sorting passage 23 based on results of detection by the coin identifying unit 57 and the detecting unit 64, as well as the distance by which the coin is transported by the transporting belt 72, coins are sorted by unit of the sorting gates 63 of the respective corresponding denominations.

At that time, based on the result of identification of the denominations of the coins in the identifying passage 22, the sorting gates 63, which can be operated by unit of an electric driving unit, are opened or closed in the sorting passage 23 so that the coins are sorted into the sorting holes 62 by opening the corresponding sorting gates 63. Therefore, the coins can be reliably sorted.

As the sorting passage 23 is arranged so as to extend in the direction going towards the back of the machine body 11 and pass through the central area of the accommodating and ejecting units 27, the coins sorted in the sorting passage 23 fall to the central area of the accommodating and ejecting units 27 and are easily distributed throughout the accommodating and ejecting units 27.

Next, a dispensing process is explained.

In response to a dispensing process command given from, for example, a POS cash register, the ejecting belt 92 rotates, while the reverse roller 95 rotates in the opposite to direction, so that coins on the ejecting belt 92 in a non-aligned state are aligned into a single layer in single file and transported in the ejecting direction.

In each of the accommodating and ejecting units 27 that handle dispensed coins of the denomination concerned, the stopper 97 is opened, and coins are ejected from the end of the ejecting belt 92 to the dispensing and transporting unit 28. The ejected coins are counted by detecting with the detecting unit 96.

In each of the accommodating and ejecting units 27 that do not handle dispensed coins of the denomination concerned and the accommodating and ejecting units 27 from which a required number of coins have been ejected, the stopper 97 is closed to prevent ejection of coins.

The coins ejected to the dispensing and transporting unit 28 are transported forward and released into the release tray 19.

The dispensing and transporting unit 28 may start to operate simultaneously with the start of ejection operation from the accommodating and ejecting units 27 or after completion of the ejection operation.

In cases where operation of the dispensing and transporting unit 28 is initiated simultaneously with the start of ejection operation from the accommodating and ejecting units 27, it is not only possible to reduce the time required for the dispensing process but also enables more accurate transaction, because the coins are transported to the release tray 19 sequentially by denomination so that coins of the denomination positioned closest to the front side of the machine body 11 are transported first, making it easier to visually confirm the denominations of the dispensed coins.

On the other hand, in cases where operation of the dispensing and transporting unit 28 is initiated after completion of the ejection operation from the accommodating and ejecting units 27, transport of the coins to the release tray 19 is not initiated until all the coins to be dispensed have been ejected onto the dispensing and transporting unit 28. Therefore, should there be any delay in the ejection of a coin for some reason, it is possible to prevent irregularities in cash dispensing, such as only some of the required coins being released into the release tray 19 and a lengthy amount of time before all the remaining coins are transported, resulting in failure to recover all coins.

In a recovery process, it is desirable to initiate operation of the dispensing and transporting unit 28 simultaneously with the start of ejection operation from the accommodating and ejecting units 27 in order to reduce the processing time, because a considerably large quantity of coins are ejected in a recovery process, compared with a coin dispensing process.

If the full-state sensor 20 of the release tray 19 detects that the release tray 19 is full during a recovery process, ejection operation from the accommodating and ejecting units 27 is temporarily stopped. Then, after the coins ejected to the dispensing and transporting unit 28 are transported to the release tray 19, the transport operation is stopped. Thereafter, when the full-state sensor 20 no longer detects the state of the release tray 19 as being full as a result of all the ejected coins in the release tray 19 having been removed by the user, ejecting operation is automatically resumed. This function of the coin depositing and dispensing machine is capable of not only preventing the spilling of coins or other cash-related irregularities resulting from what would occur due to the release tray 19 becoming full, but also reducing the burden imposed on the user, because ejecting operation is automatically resumed.

With a coin depositing and dispensing machine having a structure described above, providing an endless transporting belt 72 above the identifying passage 22 and the sorting passage 23 in such a manner that the transporting belt 72 is stretched across a plurality of pulleys 71 rotatably supported by vertically extending shafts 71*a* reduces the space required to be provided above the coin passage to install the transporting belt 72. As a result of this arrangement, it is possible to make the machine body 11 more compact in height, or increase the coin accommodating capacity of the accommodating and ejecting units 27 by the amount equivalent to the volume of the reduction of the space.

With regard to recent situation of coin depositing and dispensing machines used in coin register change machines for stores and at counters of financial institutions, there has been an increasing demand for enabling coin depositing and dispensing machines to accommodate a greater quantity of coins without making the machine body larger, in order to ensure efficient handling of coins without causing failure in receiving or dispensing coins during a transaction. However, in a conventional coin depositing and dispensing machine, the coin passage has an L-like shape, and the accommodating and ejecting units are juxtaposed in a widthwise direction of the machine body, which is a factor in causing both the width and depth of the machine body large.

The present invention solves this problem by providing the feeding mechanism 21 and the identifying passage 22 along the front end of the machine body 11 in the widthwise direction of the machine body 11 and arranging the sorting passage 23 and the plurality of accommodating and ejecting units 27 so as to extend in the direction of the depth of the machine body 11. Providing the feeding mechanism 21 and the identifying passage 22 along the front end of the machine body 11, in the widthwise direction of the machine body 11 reduces the dimension of the feeding mechanism 21 and the identifying passage 22 in the depth direction of the machine body 11, thereby securing a space in the back of the machine body 11. Arranging the sorting passage 23 and the accommodating and ejecting units 27 along the direction of the depth of the machine body 11 makes it possible to increase the coin accommodation capacity by using the secured space to increase the dimension of each accommodating and ejecting unit 27 in the depth direction of the machine body 11. Therefore, by forming the coin passage 24 in a T-like shape, the capacity of accommodating coins can be increased without making the machine body 11 larger.

Furthermore, as the sorting passage 23 is arranged so as to extend in the direction going towards the back of the machine body 11 and pass through the central area of the accommodating and ejecting units 27, the coins sorted in the sorting passage 23 fall to the central area of the accommodating and ejecting units 27 and are easily distributed throughout the accommodating and ejecting units 27. Therefore, it is possible to increase the capacity of accommodating coins without making the machine body 11 larger.

As the feeding mechanism 21 has a structure that includes the feeding belt 32 and the separation roller 40, the feeding mechanism 21 can be made more compact than a conventional mechanism using a rotating disk.

A coin feeding device is comprised of the feeding mechanism 21, the coin passage 24, the transporting unit 25, the delivery unit 26, the detecting unit 86, the controller 111, and other components. To be more specific, the coin feeding device includes the feeding mechanism 21 for receiving coins from the coin input port 14 and feeding the received coins one at a time; the coin passage 24 for receiving the coins fed from the feeding mechanism 21; the transporting belt 72 that is stretched above the coin passage 24 and is provided with protrusions 73 for pushing and thereby transporting coins one at a time in the coin passage; the delivery unit 26 including the pushing portions 84 for pushing the rim of each one of the coins fed one at a time from the feeding mechanism 21, thereby delivering the coins to the protrusions 73 of the transporting belt 72, and restraining portions 85 for separating the succeeding coin from a coin that is being delivered and holding back the succeeding coin until the time for the next delivery action; the detecting unit 86 for detecting the feeding of a coin from the feeding mechanism 21; and the controller 111 for detecting a coin by unit of the detecting unit 86 so as to enable one at a time to be delivered to the protrusions 73 of the transporting belt 72.

With the structure of the coin feeding device described above, a pushing portion 84 of the delivery unit 26 pushes the rim of a coin fed from the feeding mechanism 21 to deliver the coin to a protrusion 73 of the transporting belt 72 of the coin passage 24, and a restraining portion 85 of the delivery unit 26 separates the succeeding coin fed from the feeding mechanism 21 and retains the succeeding coin until the time for the next delivery action, thereby reliably delivering the coins one at a time to the protrusions 73 of the transporting belt 72. As a result of this structure, it is possible to reduce faulty transport by preventing a foreign object from entering the coin passage 24. Furthermore, employing the delivery unit 26 not only enables coins fed from the feeding mechanism 21 to be reliably delivered to the protrusions 73 of the transporting belt 72 one at a time, regardless of the structure of the feeding mechanism 21 or of the coin passage 24, but also provides a compact coin feeding device by making the feeding mechanism 21 and the coin passage 24 more compact.

To be more specific, as in the case of a conventional coin feeding device, a structure where coins are fed one at a time simply by using a feeding belt and a separation roller (see Patent Document 1 referred to in Background Art) or a structure where coins are fed one at a time simply by rotating a horizontal rotating disk (for example, see Japanese Laid-open Patent Publication No. 2002-298184) may cause foreign objects that are intermingled with the coins on the feeding belt or the rotating disk to be fed to the coin passage, thereby constituting a factor to cause faulty transport. A coin feeding device having a structure according to the present embodiment described above is capable of reducing faulty transport by preventing a foreign object from entering the coin passage 24.

As in the case of JP '678 referred to previously, in cases where a coin picked up by a picking-up member of a rotating disk tilted at a predetermined angle with respect to a horizontal direction is delivered to a transporter protrusion of a transporting belt, and the coin is transported by the transporter protrusion pushing the rim of the coin, it is very rare for a foreign object in a hopper to be inadvertently fed. However, as a rotating disk is used in a feeding mechanism and, in addition, the rotating disk is provided in a tilted state, a disproportionately large space in height and depth with respect to the sizes of coins to be handled is required, making it difficult for a coin feeding device that is large to be used as a coin feeding device of a compact coin register change machine for a store or of a coin depositing and dispensing machine at a counter of a financial institution. However, a coin feeding device with a structure according to the present embodiment described above is capable of reducing faulty transport by preventing a foreign object from entering the coin passage 24. Furthermore, employing the delivery unit 26 not only enables coins fed from the feeding mechanism 21 to be reliably delivered to the protrusions 73 of the transporting belt 72 one at a time, regardless of the structure of the feeding mechanism 21 or of the coin passage 24, but also provides a compact coin feeding device by making the feeding mechanism 21 and the coin passage 24 more compact.

Furthermore, the delivery unit 26 has a circular cam 81, which is rotatably supported by a vertically extending shaft 81*a* and adapted to be rotated by unit of an electric driving unit, and at least two each pushing portions 84 and restraining portions 85 are provided on the circumference of the cam 81. As a result of this structure, wherein delivery of coins is performed by rotation of the circular cam 81, which is provided with at least two each pushing portions 84 and restraining portions 85 on the circumference of the cam 81, smooth delivery of coins is ensured.

What serves as the transporter is not limited to a transporting belt 72, and any other appropriate member, such as a wire or a chain, may be used. If such is the case, the rotating elements are not limited to pulleys 71, and other appropriate members, such as rollers or sprockets, may serve as the rotating elements.

The delivery unit is not limited to a cam 81; for example, by using a belt provided with a plurality of protrusions on the peripheral face of the belt, coins fed from the feeding mechanism 21 can be received one at a time between the protrusions, which push the received coins to the identifying passage 22 while holding back the succeeding coins.

Sorting of coins in the sorting passage 23 may be performed based on their shapes by unit of sorting holes that are formed in the passage face portion 51 in such a shape and size corresponding to different diameters of coins and arranged in order from coins with the smallest diameter to coins with the largest diameter.

The number of accommodating and ejecting units 27 is not limited to six.

Unlike the sorting of coins based on their sizes by units using different sorting holes for different coin diameters, denominations of coins sorted and accommodated by the accommodating and ejecting units 27 may be set in any desired manner. For example, in cases where a coin depositing and dispensing machine according to the present invention is used as a coin register change machine at a supermarket or the like, by arranging denominations that start with the numeral "1", which are most frequently dispensed, in the order of, for example with Japanese currency, 10 yen, 1 yen, and 100 yen, in the front-to-back direction of the machine body 11, and by arranging denominations that start with the numeral "5" following them in the order of 50 yen, 5 yen, and 500 yen, going in the direction towards the back of the machine body 11, it is possible to reduce the distance between the release tray 19 and an accommodating and ejecting unit 27 for a frequently dispensed denomination, and thereby reduce the dispensing processing time.

Furthermore, it is also possible to allocate a plurality of denominations to a single accommodating and ejecting unit 27 so that the accommodating and ejecting unit 27 also handles a denomination to be excluded from the dispensing process and/or a denomination for which the corresponding accommodating and ejecting unit 27 is filled up with coins. As a result, the number of recovery operations for coins from the accommodating and ejecting units 27 can be reduced, thereby enabling long-term nonstop operation of the coin depositing and dispensing machine.

As another embodiment of the invention, it is possible to make the sorting hole at the downstream-most side have such a dimension as to limit the coins that fall through to coins with the smallest diameter. By using such a structure, it is possible to eliminate the electrically operable sorting gate 63 of the aforementioned sorting hole and its electrical driving unit and thereby reduce production costs. Furthermore, even if the machine stops operation due to depositing or transport trouble or any other reasons in a state where coins remain in the sorting passage 23, there is no possibility of a user or anyone else who is manually removing the remaining coins accidentally dropping a coin with a diameter greater than the smallest diameter into the sorting hole located at the downstream-most side with respect to the transporting direction, because no coins other than those with the smallest diameter are permitted to fall through this sorting hole into the corresponding accommodating and ejecting unit 27. Thus, cash-related irregularities resulting from intermingling of coins of different denominations can be prevented.

The present invention is used, for example, as a coin depositing and dispensing machine that is electrically connected to cashier equipment, such as a POS cash register, an electronic cash register, or a teller management machine, and enables depositing and dispensing of cash to be performed automatically according to electrical signals from such cashier equipment.

The invention claimed is:

1. A coin depositing and dispensing machine comprising:

a feeding mechanism for receiving coins that have been input into a coin input port and feeding the received coins one at a time;

an identifying passage disposed parallel to a generally horizontal base for identifying the denomination of each coin fed from the feeding mechanism;

a sorting passage disposed parallel to the generally horizontal base and extending continuously from the identifying passage in a horizontal orientation and serving to sort coins;

a transporting unit provided with:

a plurality of rotating elements provided above the identifying passage and the sorting passage, the plurality of rotating elements rotatably supported in a horizontal direction by vertically extending shafts with respect to the identifying passage and the sorting passage, an endless transporter stretched above the identifying passage and the sorting passage by the rotating elements, and a plurality of protrusions protruding downward from the transporter;

wherein the transporting unit places the coins between the identifying passage, the sorting passage, and the transporter, such that the transporting unit transports the coins by pushing the coins one at a time by the protrusions;

a delivery unit for receiving coins from the feeding mechanism and delivering the received coins one at a time to the protrusions of the transporter; and a plurality of accommodating and ejecting units provided below the sorting passage and serving to accommodate coins sorted in the sorting passage and to eject accommodated coins;

each accommodating and ejecting unit being provided with an ejecting belt serving as the bottom face of the accommodating and ejecting unit adapted to receive and accommodate coins in a non-aligned state, and a reverse roller disposed above a location near the electing end of the ejecting path of the ejecting belt and adapted to be rotated in the direction opposite to a coin ejecting direction of the ejecting belt so that coins on the ejecting belt in a non-aligned state become aligned and are fed in a single layer in single file.

2. The coin depositing and dispensing machine as claimed in claim 1, wherein the feeding mechanism includes:

a receiving and accommodating unit for receiving and accommodating, in a non-aligned state, coins that have been input into the coin input port;

a feeding belt extending along the front end of the machine body in the widthwise direction of the machine body so as to serve as a bottom face of the receiving and accommodating unit and form a coin feeding path having a feeding end at which the feeding belt is connected to the delivery unit and a starting end of the identifying passage; and a separation roller disposed above a location near the feeding end of the coin feeding path of the feeding belt and adapted to be rotated in the direction opposite to a coin feeding direction of the feeding belt so that coins on the feeding belt in a non-aligned state become aligned and are fed in a single layer in single file.

3. The coin depositing and dispensing machine as claimed in claim 2, wherein:

the identifying passage extends along the front end of the machine body in the widthwise direction of the machine body so that coins are carried in the identifying passage in the direction opposite to the coin feeding direction of the feeding mechanism.

4. The coin depositing and dispensing machine as claimed in claim 1, wherein:

a plurality of sorting holes for sorting coins are provided in the bottom face of the sorting passage;

at least the sorting holes that are not located at the downstream-most side with respect to a coin transporting direction are respectively provided with a sorting gate operable by an electric driving unit; and each sorting gate is adapted to be opened or closed based on the result of identification of the denomination of a coin in the identifying passage so that coins are sorted into the sorting holes allocated to the respective denominations of the coins by opening the corresponding sorting gates.

5. The coin depositing and dispensing machine as claimed in claim 4, wherein:

a sorting hole located at the downstream-most side limits the coins that fall through to coins with the smallest diameter among the coins to be handled.

6. The coin depositing and dispensing machine as claimed in claim 1, wherein the delivery unit includes:

a pushing portion for pushing the rim of a coin fed from the feeding mechanism and thereby delivering the coin to a protrusion of the transporter; and a restraining portion for separating a succeeding coin from the coin that is being delivered and holding back the succeeding coin until a succeeding delivery.

7. A coin depositing and dispensing machine comprising:

a feeding mechanism for receiving coins that have been input into a coin input port and feeding the received coins one at a time;

an identifying passage disposed parallel to a generally horizontal base for identifying the denomination of each coin fed from the feeding mechanism;

a sorting passage disposed parallel to the generally horizontal base and extending continuously from the identifying passage in a horizontal orientation and serving to sort coins;

a transporting unit provided with:

a plurality of rotating elements provided above the identifying passage and the sorting passage, the plurality of rotating elements rotatably supported in a horizontal direction by vertically extending shafts with respect to the identifying passage and the sorting passage, an endless transporter stretched above the identifying passage and the sorting passage by the rotating elements, and a plurality of protrusions protruding downward from the transporter;

wherein the transporting unit places the coins between the identifying passage, the sorting passage, and the transporter, such that the transporting unit transports the coins by pushing the coins one at a time by the protrusions;

a delivery unit for receiving coins from the feeding mechanism and delivering the received coins one at a time to the protrusions of the transporter; and a plurality of accommodating and ejecting units provided below the sorting passage in such a manner as to be juxtaposed in the direction going towards the back of the machine body;

each accommodating and ejecting unit being provided with:

an ejecting belt serving as the bottom face of the accommodating and ejecting unit adapted to receive and accommodate coins in a non-aligned state; and a reverse roller disposed above a location near the ejecting end of the ejecting path of the ejecting belt and adapted to be rotated in the direction opposite to a coin ejecting direction of the ejecting belt so that coins on the ejecting belt in a non-aligned state become aligned and are fed in a single layer in single file wherein the feeding mechanism extends along the front end of the machine body in the widthwise direction of the machine body;

the identifying passage extends continuously from the feeding mechanism along the front end of the machine body in the widthwise direction of the machine body so that coins are carried in the identifying passage in the direction opposite to the coin feeding direction of the feeding mechanism; and the sorting passage extends continuously from the identifying passage in a direction going towards the back of the machine body.

8. The coin depositing and dispensing machine as claimed in claim 7, wherein:

the sorting passage extends in the direction going towards the back of the machine body so as to pass through a central area of the accommodating and ejecting units.

9. The coin depositing and dispensing machine as claimed in claim 7, wherein:

the identifying passage extends in the direction opposite to the coin feeding direction of the feeding mechanism and then, at a location near a side face of the machine body, the identifying passage changes the coin transporting direction and is connected to the sorting passage; and the identifying passage includes a rejected coin diverting portion for diverting a rejected coin based on the result of identification of the denomination of the coin, the rejected coin diverting portion being provided at a location near the side face of the machine body.

10. The coin depositing and dispensing machine as claimed in claim 1, wherein the feeding mechanism includes:

a feeding belt laid across a plurality of rollers supported by horizontally extending shafts so that the feeding belt slants upward from an upstream side to a downstream side with respect to the feeding direction, the feeding belt having a bent portion formed between the upstream side and the downstream side of the feeding belt so that the inclination angle of the feeding belt changes at the bent portion;

a feeding belt guide for supporting, from below, the feeding belt excluding the portion at which the bent portion is located;

a separation roller provided above the feeding belt, at a location upstream of the bent portion with respect to the feeding direction, and facing the feeding belt at such a distance therefrom as to enable passage of only a single coin, thereby aligning coins into a single layer in single file;

a regulating member provided above and facing the bent portion of the feeding belt at such a distance therefrom as to enable passage of only a single coin; and a movable support for supporting the bent portion of the feeding belt from below in such a manner as to permit the feeding belt to sag downward as a result of the bent portion being pushed by a coin that is being fed while the regulating member guides the coin.

11. The coin depositing and dispensing machine as claimed in claim 10, wherein:

the movable support is a roller rotatable in the coin feeding direction of the feeding belt.

12. The coin depositing and dispensing machine as claimed in claim 10, wherein:

a stopping unit for forcibly stopping feeding of a coin even when the feeding belt is in operation is provided at the downstream side of the feeding belt with respect to the coin feeding direction; and the regulating member is provided above and faces an area of the feeding belt extending from the bent portion to the stopping unit, at such a distance from the feeding belt as to enable passage of only a single coin.

13. The coin depositing and dispensing machine as claimed in claim 11, wherein:

a stopping unit for forcibly stopping feeding of a coin even when the feeding belt is in operation is provided at the downstream side of the feeding belt with respect to the coin feeding direction; and the regulating member is provided above and faces an area of the feeding belt extending from the bent portion to the stopping unit, at such a distance from the feeding belt as to enable passage of only a single coin.

* * * * *